US008186516B2

(12) United States Patent
Gudenburr et al.

(10) Patent No.: US 8,186,516 B2
(45) Date of Patent: May 29, 2012

(54) DOCUMENT PROCESSING SYSTEM HAVING A TURN-AROUND LOOP WITH COMPONENT REPOSITIONING

(75) Inventors: John Gudenburr, Canton, MI (US); Michael John Kiplinger, Kalamazoo, MI (US); Johan P. Bakker, Brighton, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 579 days.

(21) Appl. No.: 12/145,542

(22) Filed: Jun. 25, 2008

(65) Prior Publication Data

US 2009/0322019 A1 Dec. 31, 2009

(51) Int. Cl.
*B07C 5/02* (2006.01)

(52) U.S. Cl. ..... 209/538; 209/534; 209/540; 209/701

(58) Field of Classification Search ..... 209/534, 209/538, 540, 701; 382/101, 137, 140; 194/205, 194/210

See application file for complete search history.

(56) References Cited

U.S. PATENT DOCUMENTS

| | | | | |
|---|---|---|---|---|
| 5,534,682 | A * | 7/1996 | Graef et al. | 235/379 |
| 5,673,333 | A * | 9/1997 | Johnston | 382/137 |
| 6,103,985 | A * | 8/2000 | Shell et al. | 209/587 |
| 7,342,691 | B2 * | 3/2008 | Ju et al. | 358/472 |
| 2004/0252141 | A1 * | 12/2004 | Ju et al. | 347/2 |
| 2005/0029168 | A1 * | 2/2005 | Jones et al. | 209/534 |
| 2006/0250662 | A1 * | 11/2006 | Heit | 358/474 |
| 2010/0166288 | A1 * | 7/2010 | Spall et al. | 382/137 |

* cited by examiner

*Primary Examiner* — Terrell Matthews
(74) *Attorney, Agent, or Firm* — Honigman Miller Schwartz and Cohn LLP

(57) ABSTRACT

A document processing system is disclosed. The document processing system includes one or more document guide components defining a path of travel of documents, the path of travel of documents including an intersection portion. The document processing system also includes a component repositioning element at the intersection portion of the path of travel of documents, the component repositioning element arranged to align a document processing component with a portion of the path of travel in which a document resides.

18 Claims, 6 Drawing Sheets

DOCUMENT PROCESSING SYSTEM HAVING A TURN-AROUND LOOP WITH COMPONENT REPOSITIONING

TECHNICAL FIELD

The present disclosure relates generally to features of a document processing system. More specifically, the present disclosure relates to a document processing system having a turn-around loop with component repositioning.

BACKGROUND 100 billion check-based transactions are made in the United States each year. Many of these check transactions are still cleared by physical processing and transporting of the original printed paper check. When checks are processed for payment, the routing and account information on the front of the check is read, and images are captured of the front and back sides of the check to capture information written on the check by a payer and any endorsements on the back of the check by the payee. Check processing systems at financial institutions and consumer locations do so by passing a large number of checks through large check processing systems to enter these checks into the financial systems computers for payment. Recently, smaller and faster check processing systems, having shorter document travel distances, have been introduced for check processing at different types of places of business, thereby allowing the business to digitize the information on the check.

For example, a range of small, low-cost table-top devices exist and are used in various places of business. These document processing systems are designed to feed numbers of documents, such as checks and like financial instruments, singly, from a stack, and sequentially perform various processing functions upon them. One such processing function is capturing a digital image of the document. As the size and cost targets of this class of devices have reduced, the relative cost of the digital imaging means (hereinafter 'scanners' or 'cameras') employed has assumed a greater and greater part of the overall cost. In response to this, workers have sought innovative ways to enable one scanner to capture an image of both sides of a given document, thus eliminating the significant cost of a second scanner and associated electronic processing means.

For example, in U.S. Pat. No. 6,103,985, Shell et al taught a turn-around loop apparatus which first passes the document face before an image scanner, then through a loop which reverses the document and passes it again past the same scanner, which then captures an image of the reverse face. Shell et al. taught the use of 'switch points' to enable this bi-directional arrangement and ensure that documents driven through such a loop track would be directed to the correct directions within the track, according to the direction in which they are passing the scanner. Shell et al. described securing the scanner in a fixed position and constrain the documents to pass bi-directionally in front of the scanner. This was the purpose and function of the 'switch points' of that patent.

The 'switch points' or document-activated gates described in Shell et al. are costly to manufacture, present difficulties in manufacture and service, and can cause document jams and other failures since they are entirely dependent for their correct function on the stiffness, integrity and kinetic energy of the passing document. However, the desire to reduce cost in a document processing system remains.

For these and other reasons, improvements are desirable.

SUMMARY

In accordance with the present disclosure, the above and other problems are solved by the following:

In a first aspect, a document processing system is disclosed. The document processing system includes one or more document guide components defining a path of travel of documents, the path of travel of documents including an intersection portion. The document processing system also includes a component repositioning element at the intersection portion of the path of travel of documents, the component repositioning element arranged to align a document processing component with a portion of the path of travel in which a document resides.

In a second aspect, method of processing documents in a document processing system is disclosed. The method includes receiving a document into a path of travel of a document processing system, and moving the document along the path of travel past an intersection portion of the path of travel. The method also includes repositioning a document processing component located approximately at the intersection portion, and moving the document along a remainder of the path of travel, the remainder including the intersection portion.

In a third aspect, a document processing system is disclosed. The document processing system includes one or more document guide components defining a path of travel of documents, the path of travel of documents including an intersection portion. The document processing system also includes a component repositioning element at the intersection portion of the path of travel of documents, the component repositioning element arranged to pivot a image scanner between first and second positions, the first position aligned with a first portion of the path of travel and the second position aligned with a second portion of the path of travel.

DETAILED DESCRIPTION

Figure 1:
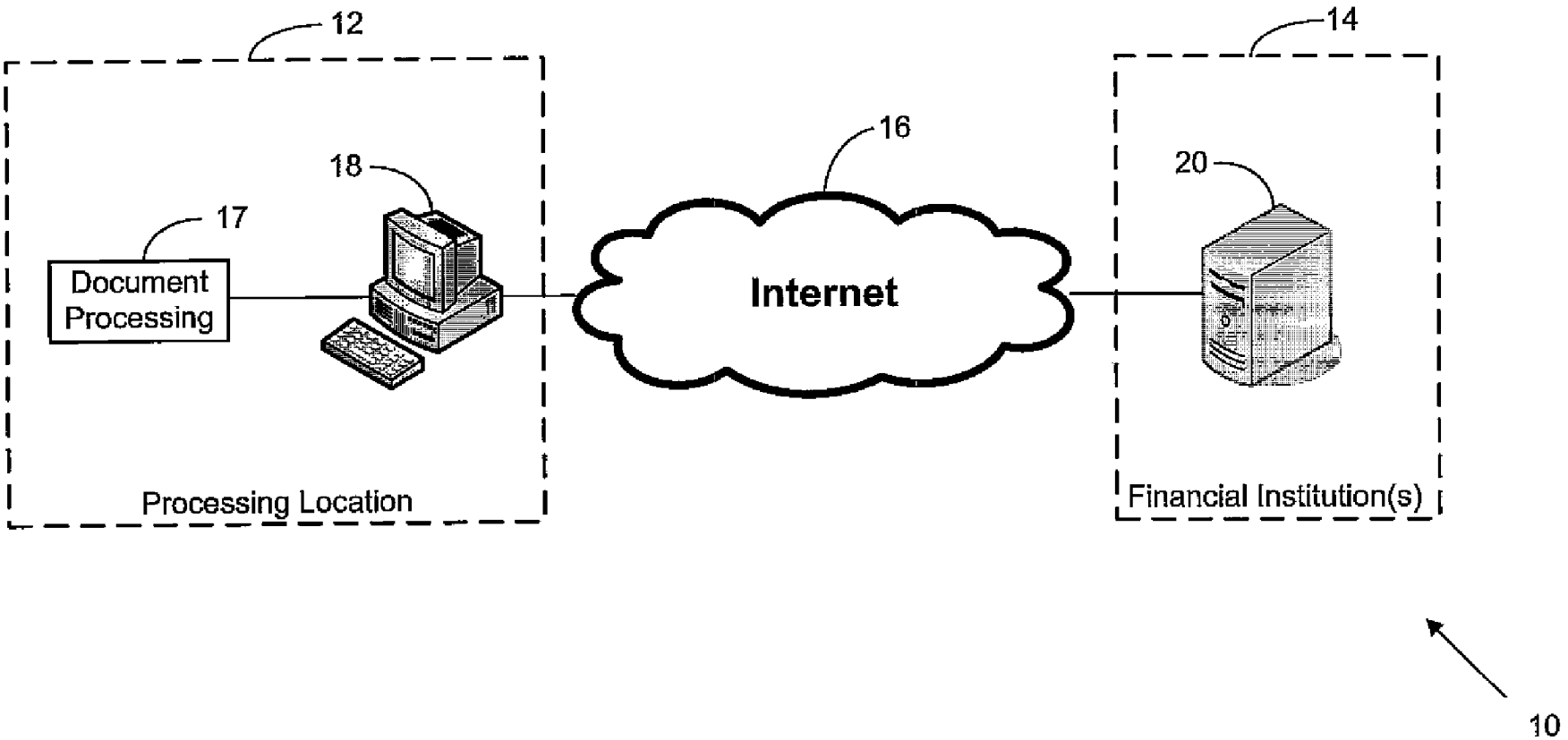
FIG. 1 is a schematic depiction of a network in which an electronic financial transaction may be placed, in accordance with the present disclosure.

Various embodiments of the present disclosure will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

The logical operations of the various embodiments of the present disclosure can, in certain embodiments, be implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits.

In general, the present disclosure relates to a document processing system having a turn-around loop in a path of travel of documents. The document processing system includes a document processing component at an intersection portion that at least partially defines the turn-around loop. At the intersection portion, the path of travel intersects with itself at an angle, such that first and second intersecting portions pass through the same point. The document processing component, such as a scanning or printing element, can be moved to align with the differing, intersecting portions of the path of travel. The document processing system can be a check processing system, a printer, or other movable-document systems.

Document processing systems implementing the features described herein have a number of advantages. By including a turn-around loop, a single document processing component (e.g. a scanner) can be used to act on both sides of a document. This dual use of a single component saves space and cost in the document processing system. Due to the space and cost savings, document processing systems, such as check processing systems can be more pervasive, located at places of business or other locations where consumer transactions take place, to print receipts, process checks or other documents, or perform other computerized actions on printed documents.

One specific example of a system in which a document processing system may be used is shown in FIG. 1. FIG. 1 illustrates a schematic view of a network 10 in which a financial transaction may take place, according to a possible embodiment of the present disclosure. The network 10 generally includes one or more document processing locations 12 and financial institutions 14, communicatively connected by a network, shown as the internet 16. A document processing location 12 may be any of a number of places of business at which a financial transaction may take processed, such as a location of a purchase or sale of goods and services, or another financial institution. Each document processing location 12 includes a document processing system 17 interconnected with a computing system 18. The document processing system 17 is arranged to provide the transaction location with the ability to electronically acquire information about a printed document, such as a check used for payment in exchange for goods and/or services. In certain embodiments, the document processing system 17 can include a check scanner and magnetic character reader, a printing device, and various sorting devices for capturing and/or printing information on one or both sides of a check.

The computing system 18 can be any of a number of types of computing systems, such as a general purpose personal computer, or a specialized computer such as a cash register or inventory system. The computing system 18 can interconnect with the document processing system 17 by any of a number of standard or specialized communication interfaces, such as a USB, 802.11a/b/g network, RF, infrared, serial, or other data connection. In certain embodiments, the computing system 18 runs an application configured to control the document processing system 17; in further embodiments, the computing system 18 receives data from the document scanner and stores and/or communicates the data (images, text, or other information) to other systems to which it is interconnected.

Each of the financial institutions 14 generally includes a computing system 20, which is configured to receive electronic records of financial transactions relevant to the financial institutions. The computing system 20 can be any of a number of types of computing systems capable of storing and managing financial transactions; in the embodiment shown, the computing system is a server system comprising one or more discrete computing units interconnected, as is known in the art.

The electronic records can be electronic transaction records, and can include scanned copies of documents memorializing financial transactions. In a particular example, an electronic record can reflect a purchase made with a check, in which the electronic record includes the relevant information on the face of the check, the routing and institution number printed on the check, and an image of one or more sides of the check, used to validate the other information and to display relevant endorsements of the check. Other electronically captured transactions, such as credit card transactions, contracts, or other negotiable instrument transactions may be tracked using the network 10 as well.

The internet connection 16 depicted can be any of a number of WAN, LAN, or other packet based communication networks such that data can be shared among a number of computing systems or other networked devices. Furthermore, although in the embodiment shown two computing devices 18, 20 at different, specific locations are depicted, the computing devices and/or the document processing system 17 may be located at the same location or within the same network.

Figure 2:
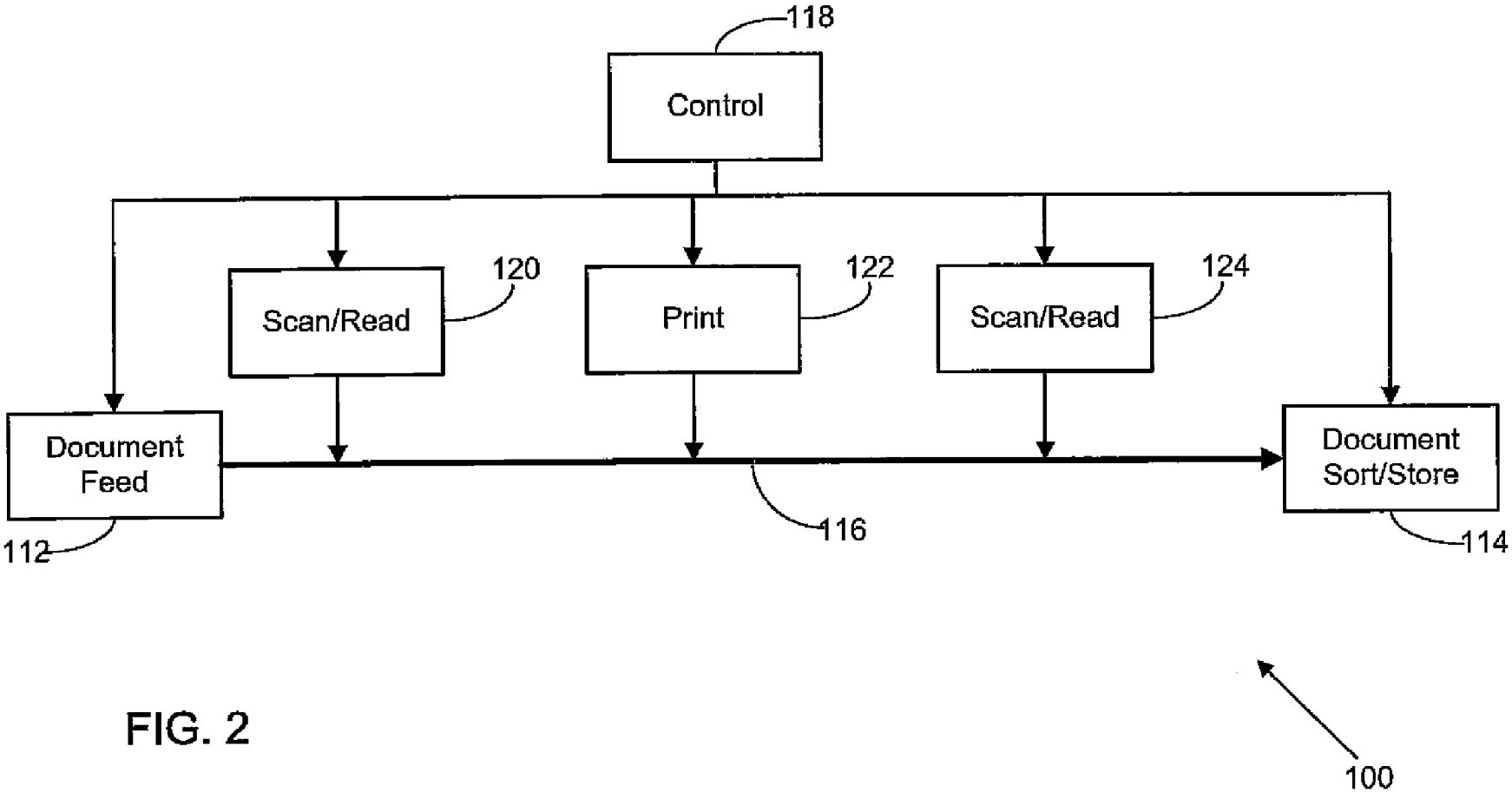
FIG. 2 is a schematic block diagram of an automated document processing system according to an embodiment of the present disclosure.

Referring now to FIG. 2, a document processing system 100 is shown in accordance with a possible embodiment of the present disclosure. The document processing system 100 provides an overview of the basic steps required to process documents, such as checks, in a high-volume system in which user supervision is minimized. The document processing system 100 can represent, for example, a possible embodiment of the document processing system 17 of FIG. 1.

In one embodiment, the document processing system 100 is a check processing system used to print and scan checks at a transaction location, financial institution or document processing company. The document processing system 100 includes a document feeder 112 interconnected with a document sorter along a path of travel 116 of documents. The document feeder 112 is generally a document take-up mechanism provided with a large number of documents that are required to be processed. The document sorter 114 is an endpoint at which the documents have been processed, and can include one or more sorting mechanisms configured to arrange physical documents in a desired manner. The path of travel 116 may be defined by any of a number of document movement and/or guiding mechanisms, such as rollers, guides, or other systems able to grip and move documents from the feeder 112 to the sorter 114.

A control system 118 is interconnected to the document feeder 112 and the document sorter 114 to control flow of documents along the path of travel 116. The control system 118 can be an application level program configured to control flow and processing of documents. The control system 118 can reside on a general purpose or specific purpose computing system capable of communicating with the feeder 112 and sorter 114. An example computing system useable for his purpose is described in conjunction with FIG. 3, below.

The control system 118 further directs a scanning system 120, a printing system 122, and a secondary scanning system 124. The scanning system 120 can scan one side of the documents passing along the path of travel 116, to store text and/or images displayed on the documents. The printing system 122 prints desired characters and/or images onto documents passing by the printing system along the path of travel 116. The printing system 122 can incorporate a print assembly which is configured to print from a stationary printing aperture onto moving documents passing by the printing system along the path of travel. In the example of a check processing system, the printing system 122 can print an endorsement onto the back of a check which is being processed at a financial institution operating the system 100. Other documents may be processed as well, by financial institutions or other document processing entities. The secondary scanning system 124 can scan and capture any information printed onto the documents by the printing system 122, thereby capturing initial and final states of the documents passing through the system 100.

In certain embodiments described herein, the scanning system 120 and secondary scanning system 124 are combined, in that a single scanning element is used to perform more than one scanning operation on a document passing along the path of travel 116. In such embodiments, the path of travel can include a turn-around loop, forming an intersection portion at which the scanning element can be located to perform a scanning operation on both sides of the document. One such embodiment is described below in conjunction with FIGS. 4-5.

Optionally (not shown), one or more document storage locations and/or exit points may lead from the path of travel 116 out from the system 100. These storage locations and exit points allow the control system an opportunity to pause documents along the path of travel 116, and to remove documents from the path of travel 116 prior to reaching the document sorter 114 in case of an error detected in scanning and/or printing.

By passing documents through the document processing system 100, a large volume of documents can be printed and electronically captured, such that various records can be stored for each of a large number of documents. In the case of a financial institution processing checks or other documents, that institution can endorse a large number of checks, can capture check images and routing information, and can appropriately sort the document for distribution back to the issuing institution of the check.

Figure 3:
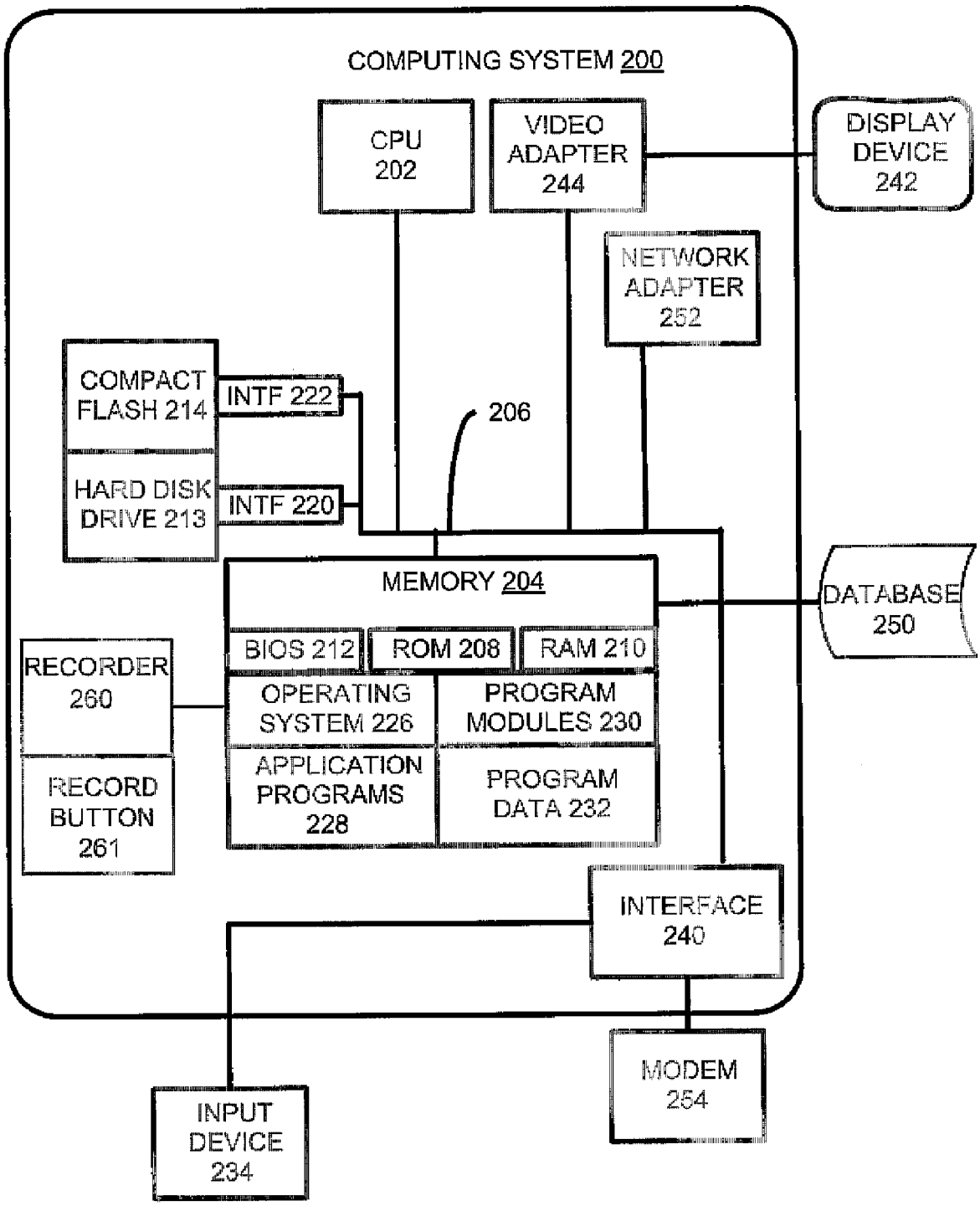
FIG. 3 illustrates a general purpose computing system for use in implementing one or more computing embodiments of the present disclosure.

Referring to FIG. 3, an exemplary environment for implementing embodiments of the present disclosure includes a general purpose computing device in the form of a computing system 200, including at least one processing system 202. In the various embodiments described herein, the general purpose computing device can correspond to the various computing devices of FIG. 1, such as that located at the transaction location 12. The computing system 200 can provide functionality for performing aspects of the present disclosure reflected in the systems and methods disclosed in FIG. 6, and can be used in conjunction with the document processing system of FIGS. 4-5. A variety of processing units 202 are available from a variety of manufacturers, for example, Intel or Advanced Micro Devices. The computing system 200 also includes a system memory 204, and a system bus 206 that couples various system components including the system memory 204 to the processing unit 202. The system bus 206 might be any of several types of bus structures including a memory bus, or memory controller; a peripheral bus; and a local bus using any of a variety of bus architectures.

Preferably, the system memory 204 includes read only memory (ROM) 208 and random access memory (RAM) 210. A basic input/output system 212 (BIOS), containing the basic routines that help transfer information between elements within the computing system 200, such as during start up, is typically stored in the ROM 208.

Preferably, the computing system 200 further includes a secondary storage device 213, such as a hard disk drive, for reading from and writing to a hard disk (not shown), and/or a compact flash card 214.

The hard disk drive 213 and compact flash card 214 are connected to the system bus 206 by a hard disk drive interface 220 and a compact flash card interface 222, respectively. The drives and cards and their associated computer readable media provide nonvolatile storage of computer readable instructions, data structures, program modules and other data for the computing system 200.

Although the exemplary environment described herein employs a hard disk drive 213 and a compact flash card 214, it should be appreciated by those skilled in the art that other types of computer-readable media, capable of storing data, can be used in the exemplary system. Examples of these other types of computer-readable mediums include magnetic cassettes, flash memory cards, digital video disks, Bernoulli cartridges, CD ROMS, DVD ROMS, random access memories (RAMs), read only memories (ROMs), and the like.

A number of program modules may be stored on the hard disk drive 213, compact flash card 214, ROM 208, or RAM 210, including an operating system 226, one or more application programs 228, other program modules 230, and program data 232. A user may enter commands and information into the computing system 200 through an input device 234. Examples of input devices might include a keyboard, mouse, microphone, joystick, game pad, satellite dish, scanner, digital camera, touch screen, and a telephone. These and other input devices are often connected to the processing unit 202 through an interface 240 that is coupled to the system bus 206. These input devices also might be connected by any number of interfaces, such as a parallel port, serial port, game port, or a universal serial bus (USB). A display device 242, such as a monitor or touch screen LCD panel, is also connected to the system bus 206 via an interface, such as a video adapter 244. The display device 242 might be internal or external. In addition to the display device 242, computing systems, in general, typically include other peripheral devices (not shown), such as speakers, printers, and palm devices. The computing system 200 can also interface with an external database 250, such as a data store resident on a separate computer or peripheral device.

When used in a LAN networking environment, the computing system 200 is connected to the local network through a network interface or adapter 252. When used in a WAN networking environment, such as the Internet, the computing system 200 typically includes a modem 254 or other means, such as a direct connection, for establishing communications over the wide area network. The modem 254, which can be internal or external, is connected to the system bus 206 via the interface 240. In a networked environment, program modules depicted relative to the computing system 200, or portions thereof, may be stored in a remote memory storage device. It will be appreciated that the network connections shown are exemplary and other means of establishing a communications link between the computing systems may be used.

The computing system 200 might also include a recorder 260 connected to the system memory 204. The recorder 260 includes a microphone for receiving sound input and is in communication with the system memory 204 for buffering and storing the sound input. Preferably, the recorder 260 also includes a record button 261 for activating the microphone and communicating the sound input to the system memory 204.

A computing device, such as computing system 200, typically includes at least some form of computer-readable media. Computer readable media can be any available media that can be accessed by the computing system 200. By way of example, and not limitation, computer-readable media might comprise computer storage media and communication media.

Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and that can be accessed by the computing system 200.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer-readable media. Computer-readable media may also be referred to as computer program product.

Figure 4:
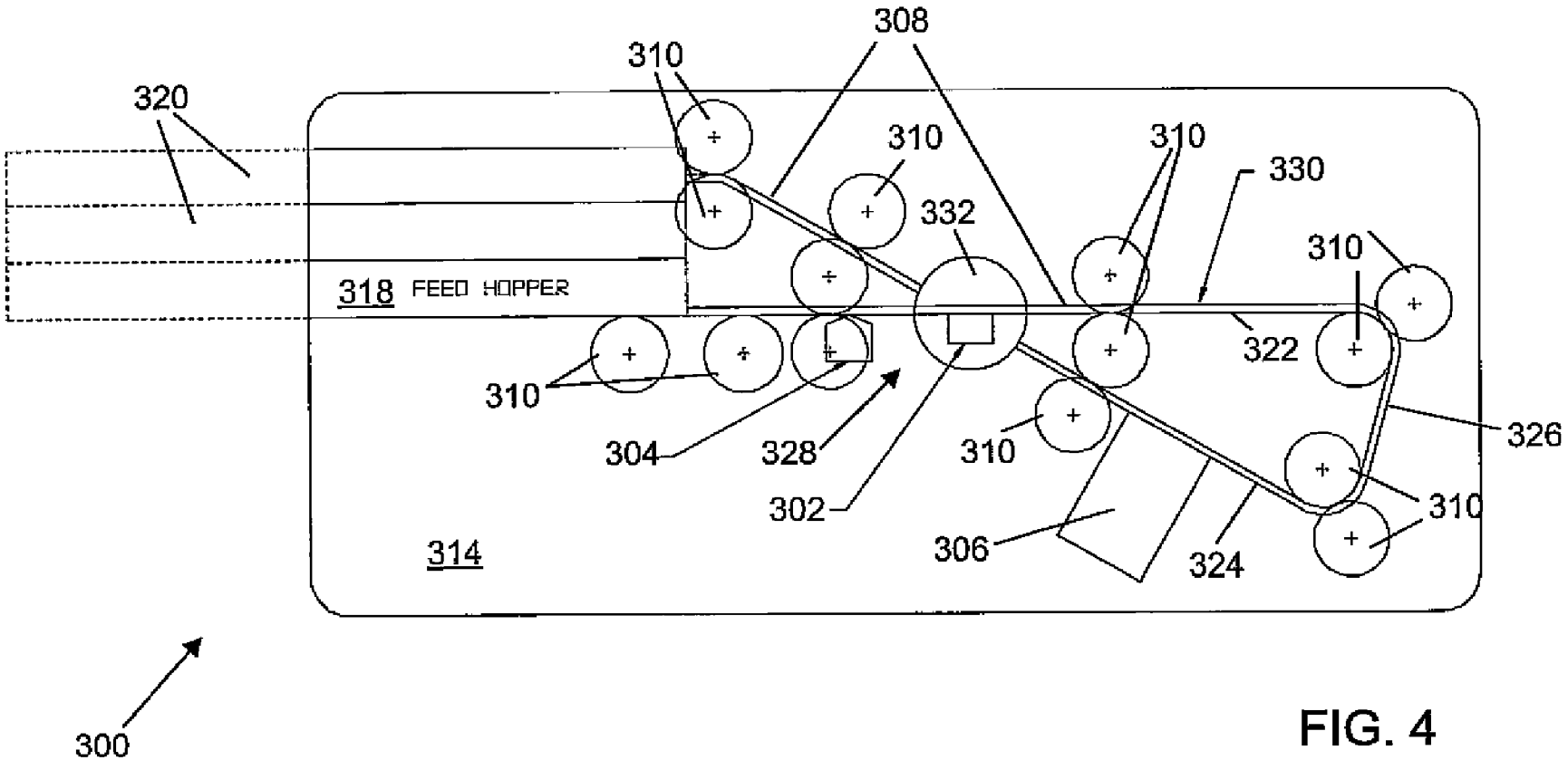
FIG. 4 is a schematic layout of a document processing system having a document processing component in a first position, according to a possible embodiment of the present disclosure.
Figure 5:
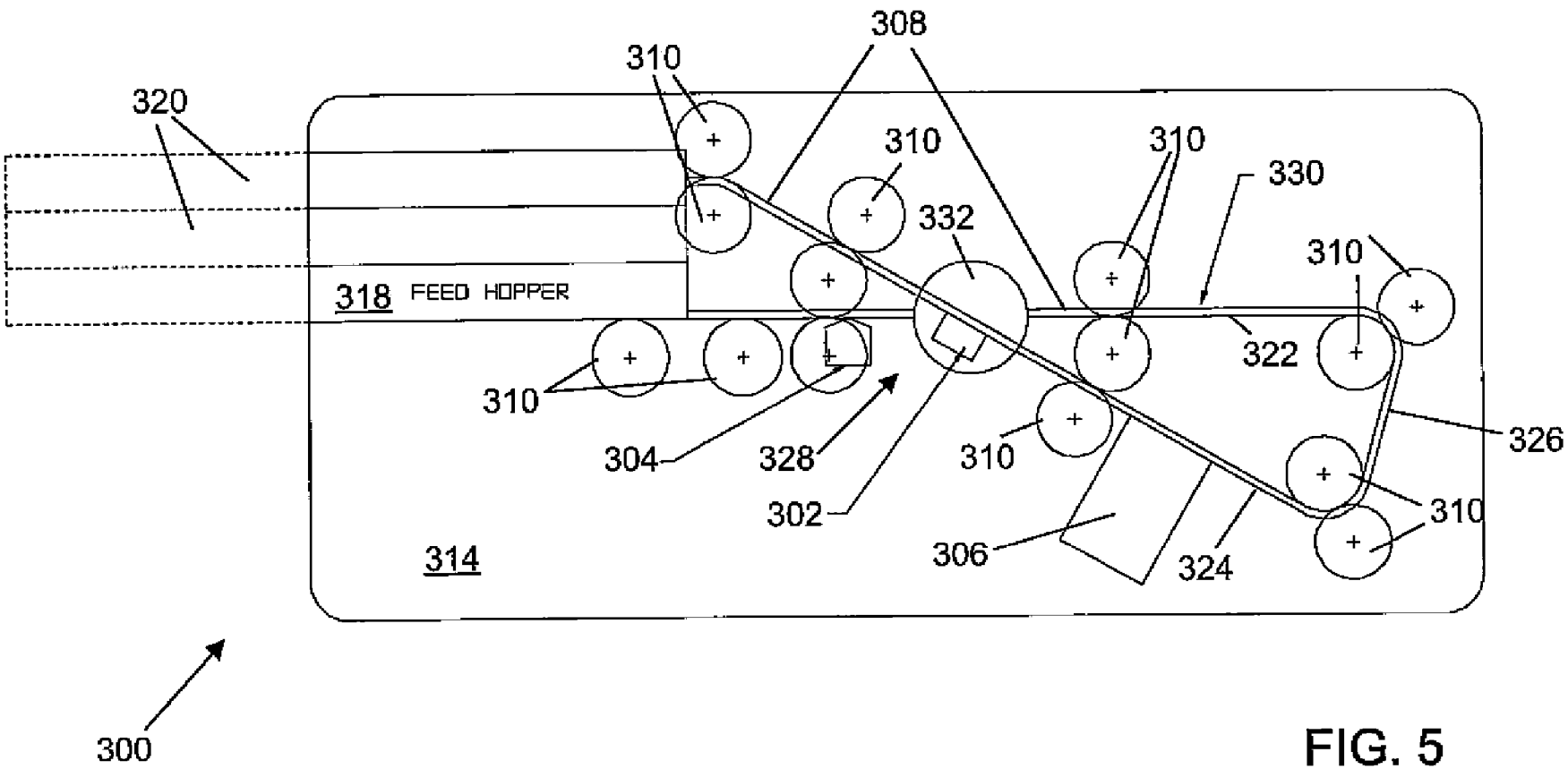
FIG. 5 is a schematic layout of the document processing system of FIG. 3, with the document processing component in a second position.

Referring now to FIGS. 4-5, a schematic layout of a document processing system 300 is shown, according to a possible embodiment of the present disclosure. The document processing system 300 is generally arranged to serially process batches of documents, and can capture information from those documents for use in a network (e.g. a financial transaction network, such as network 10 of FIG. 1). In the embodiment shown, the document processing system 300 includes a number of document processing components, including a scanning element 302, a magnetic character reader 304, and a printing element 306. Each of these elements are located along a path of travel 308, which is defined by a number of rollers 310 and a drive linkage (not shown) mounted to a base plate 314 of the document processing system.

The scanning element 302 allows the system to capture image information of a side of a document passing by that element. In various embodiments, the scanning element 302 can correspond to an image scanner or document camera able to capture image information from a document while the document is in motion past the camera. One example camera useable as the scanning element 302 is approximately 5" tall×½" wide×¼" deep, weighing approximately 2 ounces, and is capable of capturing a digital image of a passing document up to 4.50" tall at 200 dots-per-inch. Other cameras or scanning elements can be used as well, in accordance with the present disclosure, and are selected based on the size of documents desired to be captured, the speed at which the document will pass the camera, and the desired resolution of the scanned image.

The magnetic character reader 304 scans magnetic characters located in front of the reader. The reader 304 generally resides adjacent to a magnet, which induces a magnetic charge on characters printed in a magnetizable ink. The data gathered by the magnetic character reader 304 can be combined with position or speed information to transform the data collected into a signal which is matched to a signature signal representing alphanumeric characters or symbols, thereby allowing translation to digitized characters. In one example, the reader 304 charges and reads magnetic printing representing routing and account information that are printed on checks, deposit slips, or other similar documents.

The reader 304 is located at a position immediately following intake of documents from the intake mechanism, to allow the reader to obtain the character data and to allow the system 300 to transmit that data to a communicatively connected computing system (e.g. system 200 of FIG. 3) as early in the document processing process as possible. This allows a maximum amount of time after reading the characters for the linked computing system to determine whether the system 300 successfully captured the magnetic ink characters on the document.

The printing element 306 is located along the path of travel 308 following the scanning element 302, and generally includes a printing element oriented toward a rear side of the document. The printing element 306 prints one or more characters onto the document, such as the name of the institution receiving the check for processing, the time at which the check is processed, or other information. In certain embodiments, the printing element 306 can print at least a portion of the information captured by the magnetic character reader 304 or the scanning element 302.

The printing element 306 can print different information on the document based on the received indication of successful reading of characters, or can be programmed to not print at all on a document that has not been read successfully. In a further embodiment, the endorser is activated only after an indication of successful reading by the magnetic character reader 304 and the scanning element 302. Other embodiments are possible as well such as embodiments in which information is printed onto the front side of the document.

The path of travel 308 defines a path along which documents, such as checks, travel during processing within the system 300. The path of travel 308 routes each document past a variety of check processing components, including those document processing components 302, 304, 306 previously described. The path of travel 308 is defined at least in part by the plurality of rollers 310 connected by a drive linkage (not shown). The rollers 310 are generally placed in opposed pairs to rotate and guide documents along the path of travel 308. The drive linkage connects at least one roller from each pair (as well as intermediate rollers used to route the linkage around the various components 302, 304, 306), and causes each of the rollers to rotate at a uniform rate. The uniform rotation speeds of the rollers results in the path of travel 308 operating at a consistent, controllable rate.

The path of travel 308 starts at a document feeder 318, which holds documents to be processed by the system 300, and is terminated at a document recovery bin 320, which receives processed documents. In the embodiment shown, the document recovery bin 320 includes a plurality of pockets, and is capable of sorting documents between the pockets based on the type of document processed or based on success/failure of the document processing. Other embodiments, having different sizes or numbers of document feeders, document recovery bins, and pockets can be used as well.

In the embodiment shown, the path of travel 308 includes a first portion 322, a second portion 324, and a third portion 326. The first portion 322 is a generally linear portion of the track which includes, in the embodiment shown, the magnetic character reader 304. The second portion 324 is also generally linear and includes the printing element 306. The second portion 324 terminates at the document recovery bin 320. The first and second portions 322, 324 are generally non-parallel, and do not coextend (i.e. documents never "double-back" on themselves in the path of travel 308). The first and second portions 322, 324 are defined by the placement of the rollers 310. In the embodiment shown, the first and second portions 322, 324 form an angle having at least one roller 310 at an interior angle and acting to drive both portions of the path of travel simultaneously.

A section of each of the first and second portions 322, 324, as well as all of the third portion 326, form a turn-around loop 330, which causes the path of travel 308 to cross itself at an intersection 328. The turn-around loop 330 exposes opposite sides of the document to a document processing component (in the embodiment shown, the scanning element 302) located at the intersection 328. The intersection 328 connects a first portion 322 of the path of travel 308 to a second portion 324 of the path of travel at approximately the midpoints of these portions. The turn-around loop 330 is preferably of at least sufficient length that the largest document receivable by the system 300 has a length less than that of the loop, thereby avoiding a situation in which a trailing portion of the document extends across the intersection 328 in the first portion 322 when a leading edge of the document reaches the intersection 328 along the second portion 324.

The document processing system 300 also includes a component repositioning element 332 at the intersection 328. The component repositioning element 332 moves a document processing component between first and second positions, with the first position (seen, for example, in FIG. 4) in alignment with the first portion 322 of the path of travel 308 and the second position (seen, for example, in FIG. 5) in alignment with the second portion 324 of the path of travel. By repositioning the document processing component in alignment with the portion of the path of travel carrying a document, documents do not need to be redirected over a common, linear path of travel, using the "switch points" described above.

In the embodiment shown, the component repositioning element 332 is associated with the scanning element 302, and operates to pivot the scanning element between first and second positions aligned with first and second portions of the path of travel. However, in other embodiments, other document processing components, such as a printing or character reading component could be located at the intersection 328 with the component repositioning element 332.

The document processing component associated with the component repositioning element 332 generally can operate on both sides of a document passing along the path of travel, on a first side of the document when the document passes from the document feeder 318 into the first portion 322, and on an opposite side of the document when the document passes through the second portion 324 into the document recovery bin 320. Through use of the component repositioning element, documents processed by the document processing system 300 are not required to pass along a common length of the path of travel 308, thereby reducing the risk of misrouting and possible document damage to the document.

In use, a document fed from a stack of documents located in the feeder 318 is drawn into the path of travel 308. The document first passes by a magnetic character reader 304, and the front face then passes in front of the scanning element 302, where a digital image is captured on-the-fly, by scanning the face of the document as it passes. At this time, the scanning element 302 is in a first position, as shown in FIG. 4. The document then passes into the turn-around loop 330, which has the effect of reversing the presentation of the document with respect to the scanning element 302. As the tail end of the document clears the scanning element 302, the component repositioning element 326 is rotationally repositioned to a second position to accept the leading edge of the document as it returns from the turn-around loop 330, as shown in FIG. 5. The document passes the scanning element 302, which again scans the document as it passes along the second portion 324 of the path of travel. During this second scanning process, the opposite surface of the document is scanned as the document passes along a second portion 324 of the path of travel, which directs the document to one of the pockets of the document recovery bin 320, as appropriate.

It will be seen that both sides of a document may be sequentially scanned by a single scanning element (or otherwise processed by a document processing component), without the need for separate diverters, gates and other like devices to control the trajectory of the document in two different directions of travel along a common path of travel. Since the rotational function of the component repositioning element 326 exposes the document to only one input- and output path at any one time—in the manner of a railroad switch—separate switch devices are not required to ensure that the document takes the correct input or output path.

Figure 6:
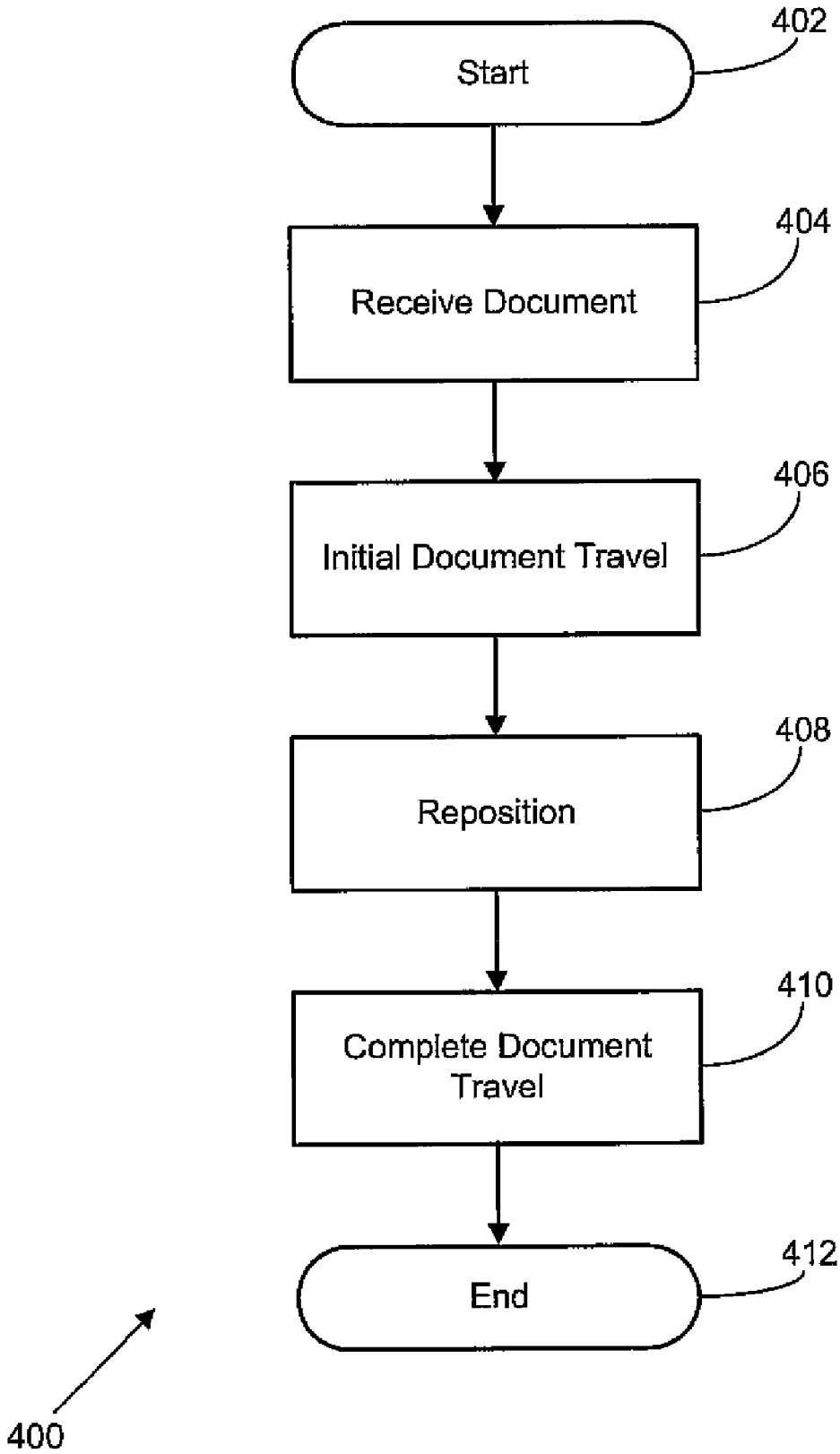
FIG. 6 is a flowchart of methods and systems for processing documents in a document processing system, according to a possible embodiment of the present disclosure.

FIG. 6 is a flowchart of methods and systems for processing documents in a document processing system, according to a possible embodiment of the present disclosure. The methods and systems 400 described herein can correspond to software, or other electrical/electromechanical instructions provided to a document processing system to perform document processing tasks. The methods and systems 400 described herein can, in various embodiments, be executed on a computing system such as that shown in FIG. 2, or in circuitry of a document processing system. In one example, the methods and systems 400 can be used in conjunction with the document processing system of FIGS. 4-5, above, to process checks or other types of documents using a document processing system having a turn-around loop and component repositioning.

In the embodiment shown, the system 400 is instantiated at a start operation 402, which corresponds to initializing operation of a document processing system. Operational flow proceeds to a document receipt module 404. The document receipt module 404 generally corresponds to receipt of a document into a path of travel of the document processing system. In an example embodiment in which the document processing system corresponds to the system 300 of FIGS. 4-5, the document receipt module 404 can correspond to receipt in a path of travel 308 from a document feeder 318.

Operational flow proceeds to a document movement module 406, which corresponds to moving the document along the path of travel of the document processing system, such that the entire document has passed a component repositioning element. Again using the document processing system 300 as an example, the document movement module 406 causes movement of a document along the first portion 322 (and optionally all or part of the third portion 326 and a part of the second portion 324) such that the document has passed the intersection 328 and is located within the turn-around loop 330.

The document movement module 406 moves the document past a document processing component (e.g. the scanning element 302 in the embodiment described in FIGS. 4-5), exposing a first side of the document to the document processing component. During operation of the document movement module 406, a document processing component resides in a first position in alignment with a first portion of the path of travel.

Following operation of the document movement module 406, operational flow proceeds to a repositioning module 408, which corresponds to repositioning a document processing component to trigger alignment of the document processing component with a second portion of the path of travel. Again using the system 300 as an example, the repositioning module 408 can direct the component repositioning element 326 such that the scanning element 302 is aligned with the second portion 324 of the path of travel.

In certain embodiments, the repositioning module 408 causes the document to pause movement in the path of travel, by pausing rotation of rollers or a linkage in contact with the document. This pause allows additional time to repositioning the document processing component, while the document resides in the turn-around loop. In further embodiments, the turn-around loop is sufficiently long and the time to reposition the document processing component is sufficiently short that the component can be repositioned while the document is traveling and residing entirely in the turn-around loop.

Operational flow proceeds to a movement completion module 410, which corresponds to moving the document along a second portion of a path of travel, past the (now realigned) document processing component. During operation of the movement completion module 410, an opposite side of the document is exposed to the document processing component, as compared to during operation of the document movement module 406. The document processing component can be directed to act on the document, thereby printing one or scanning the document according to operation of the component. Continuing the example using the document processing system 300, the document is moved along the second portion 324 of the path of travel 308 scanned by the scanning element 302, and passed into the document recovery bin 320.

In certain embodiments, the movement completion module 410 also optionally includes a second repositioning operation once the document has passed an intersection portion of the path of travel. In this second repositioning operation, the document processing component is returned from a second position to a first position, so that it is aligned with the first portion of the path of travel and is prepared to receive and process a subsequent document passing through the document processing system. Operational flow terminates at an end operation 412, which corresponds to completed processing of at least one document using the document processing system.

Referring now to FIGS. 1-6 generally, it can be seen that a compact, low cost document processing system can be provided which includes capabilities to perform a document processing action on both sides of a document, using a single document processing component. Although, in the embodiments described herein, the document processing component is a scanning element, other types of document processing components, such as printing elements or character readers could be used at the intersection of the path of travel as well.

Furthermore, although in the embodiments shown the document processing system includes certain functionalities relating to scanning and data capture relating to checks and other financial instruments, other types of document processing systems could be implemented according to the principles of the present disclosure as well. For example, a document printing system having a turn-around loop could be implemented in which a common printing element prints on opposed sides of a document, and is moved to be adjacent differing portions of the path of travel at an intersection, as described herein. It is further understood that the same operational principles apply in larger systems, or systems that process other types of documents.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A document processing system comprising: one or more document guide components defining a path of travel of documents, the path of travel of documents including an intersection portion that separates a first portion from a second portion; and a component reposition element at the intersection portion of the path of travel of one or more documents, the component reposition element arranged to align a document processing component with a first portion of the path of travel when a first side of one of the documents is closer to the document processing component than a second side of one of the documents and a second portion of the path of travel when the second side of one of the documents is closer to the document processing component than the first side of one of the documents; wherein the component repositioning element is configured to move the image scanner between first and second positions, wherein in the first position the image scanner is oriented to scan a first side of the document and in the second position the image scanner is oriented to scan a second side of the document; and wherein the path of travel includes a turn-around loop.

2. The document processing system of claim 1, wherein the one or more document guide components include a roller.

3. The document processing system of claim 1, wherein the document processing component includes an image scanner configured to capture an image of a surface of a document as the document passes through the path of travel.

4. The document processing system of claim 1, wherein the document processing system is arranged to serially receive documents from a document feeder.

5. The document processing system of claim 1, further comprising one or more document recovery bins.

6. The document processing system of claim 1, further comprising a magnetic character reader arranged to read alphanumeric characters printed on a portion of the document.

7. The document processing system of claim 1, wherein the turn-around loop has a length greater than a maximum size of a document receivable by the document processing system.

8. The document processing system of claim 1, wherein the turn-around loop has a length greater than the size of a personal check.

9. The document processing system of claim 1, further comprising an endorsing mechanism located in a turn-around loop.

10. The document processing system of claim 9, wherein the endorsing mechanism is configured to print an endorsement on a back side of a check.

11. A method of processing documents in a document processing system, the method comprising:

receiving a document into a path of travel of a document processing system;

providing a document processing component located approximately at an intersection portion of the path of travel the intersection portion separating a first portion from a second portion, wherein the document processing component is aligned with the first path of travel to process a feature on a first side of the document, and further wherein the first side of the document is closer to the document processing component and the second side of the component;

moving the document along the path of travel past the intersection portion and into the second portion of the path of travel;

repositioning the document processing component so that it is aligned with the second path of travel to process a feature on the second side of the document, wherein the second side of the document is closer to the document processing component than the first side of the document; and moving the document along a remainder of the path of travel, the remainder including the intersection portion; wherein the document processing component includes a scanning element and wherein the component repositioning element is arranged to pivot the scanning element.

12. The method of claim 11, wherein receiving a document into a path of travel of a document processing system includes receiving the document from a document feeder.

13. The method of claim 11, further comprising reading characters printed on the document with a magnetic character reader.

14. The method of claim 11, further comprising, while moving the document along the path of travel past an intersection portion, scanning a first side of the document.

15. The method of claim 14, further comprising, while moving the document along a remainder of the path of travel, scanning a second side of the document.

16. The method of claim 11, wherein moving the document along a remainder of the path of travel includes depositing the document in a document recovery bin.

17. A document processing system comprising:

one or more document guide components defining a path of travel of documents, the path of travel of documents including an intersection portion; and a component repositioning element at the intersection portion of the path of travel of documents, the component repositioning element arranged to pivot a image scanner between first and second positions, the first position aligned with a first portion of the path of travel and the second position aligned with a second portion of the path of travel, wherein the first and second paths of travel are substantially non-parallel; wherein, in the first position the image scanner captures an image of the first side of the document, and in the second position the image scanner captures an image of a second side of the document.

18. The document processing system of claim 17, wherein, in the first position the image scanner captures an image of a first side of the document, and in the second position the image scanner captures an image of a second side of the document.

* * * * *